US010024315B2

(12) United States Patent
Tao et al.

(10) Patent No.: US 10,024,315 B2
(45) Date of Patent: Jul. 17, 2018

(54) PUMP OPERATION PROCEDURE WITH PISTON POSITION SENSOR

(71) Applicant: Schlumberger Technology Corporation, Sugar Land, TX (US)

(72) Inventors: Chen Tao, Sugar Land, TX (US); Sylvain Bedouet, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 700 days.

(21) Appl. No.: 14/577,844

(22) Filed: Dec. 19, 2014

(65) Prior Publication Data

US 2016/0177942 A1 Jun. 23, 2016

(51) Int. Cl.

| | |
|---|---|
| ***G06F 19/00*** | (2018.01) |
| ***F04B 51/00*** | (2006.01) |
| ***F04B 47/00*** | (2006.01) |

(52) U.S. Cl.

CPC ..... *F04B 51/00* (2013.01); *F04B 47/00* (2013.01)

(58) Field of Classification Search

USPC ..... 702/85

See application file for complete search history.

(56) References Cited

U.S. PATENT DOCUMENTS

| | | | | |
|---|---|---|---|---|
| 5,063,775 | A | 11/1991 | Walker, Sr. et al. | |
| 7,377,333 | B1 | 5/2008 | Sugiura | |
| 7,565,835 | B2 | 7/2009 | Bittleston et al. | |
| 7,656,305 | B2 * | 2/2010 | Kennedy | F04B 47/026 340/665 |
| 8,348,642 | B2 | 1/2013 | Brennan et al. | |
| 8,613,317 | B2 | 12/2013 | Briquet et al. | |
| 8,622,966 | B2 * | 1/2014 | Causey | A61M 5/14244 604/151 |
| 8,939,930 | B2 * | 1/2015 | Li | A61M 5/155 604/131 |
| 2010/0126600 | A1 | 5/2010 | Watson | |
| 2011/0100641 | A1 | 5/2011 | Briquet et al. | |
| 2013/0014576 | A1 | 1/2013 | Pelletier | |
| 2013/0180719 | A1 | 7/2013 | Smith et al. | |
| 2015/0176370 | A1 | 6/2015 | Greening et al. | |
| 2016/0177714 | A1 | 6/2016 | Tao | |

FOREIGN PATENT DOCUMENTS

| | | | |
|---|---|---|---|
| EP | 2039935 | A2 | 3/2009 |

OTHER PUBLICATIONS

Combined Search and Examination Report issued in the related GB application 1519984.7, dated Oct. 7, 2016 (6 pages).

* cited by examiner

*Primary Examiner* — Pho M Luu
(74) *Attorney, Agent, or Firm* — Michael Dae

(57) ABSTRACT

A method for calibrating a pump assembly is disclosed. The method includes characterizing a pump of the pump assembly to determine a performance characteristics of the pump. The method may also include calibrating a sensor associated with a displacement unit of the pump assembly. Calibrating the sensor may include calibrating the sensor under operating conditions of a first environment and under operating conditions of a second environment. Under the operating conditions of the second environment, the pump can also be calibrated to determine a performance characteristics of the pump at the operating conditions of the second environment. The calibrated pump assembly is then used to draw fluid from a subterranean formation or conduct a formation test.

20 Claims, 10 Drawing Sheets

PUMP OPERATION PROCEDURE WITH PISTON POSITION SENSOR

BACKGROUND OF THE DISCLOSURE

Wells are generally drilled into subsurface rocks to access fluids, such as hydrocarbons, stored in subterranean formations. The formations penetrated by a well can be evaluated for various purposes, including for identifying hydrocarbon reservoirs within the formations. During drilling operations, one or more drilling tools in a drill string may be used to test or sample the formations. Following removal of the drill string, a wireline tool may also be run into the well to test or sample the formations. These drilling tools and wireline tools, as well as other wellbore tools conveyed on coiled tubing, drill pipe, casing or other means of conveyance, are also referred to herein as "downhole tools." Certain downhole tools may include two or more integrated collar assemblies, each for performing a separate function, and a downhole tool may be employed alone or in combination with other downhole tools in a downhole tool string.

Formation evaluation may involve drawing fluid from the formation into a downhole tool. In some instances, the fluid drawn from the formation is retained within the downhole tool for later testing outside of the well. In other instances, downhole fluid analysis may be used to test the fluid while it remains in the well. Such analysis can be used to provide information on certain fluid properties in real time without the delay associated with returning fluid samples to the surface.

SUMMARY

In an embodiment, a method is provided for calibrating a pump assembly that includes a displacement unit and one or more pumps that activate the displacement unit. The method may include characterizing the one or more pumps to determine one or more performance characteristics of the one or more pumps. Under operating conditions of a first environment, a sensor associated with the displacement unit may be calibrated as part of the method. The sensor associated with the displacement unit may also be calibrated under operating conditions of a second environment as part of the method. The method may further include calibrating the one or more pumps under operating conditions of the second environment to determine one or more performance characteristics of the one or more pumps at the operating conditions of the second environment.

In another embodiment, a method includes providing a downhole tool having a pump assembly. The pump assembly may include a displacement unit that has a piston with a first piston head positioned in a first cylinder, a second piston head positioned in a second cylinder, and a sensor that detects the position of the piston. The pump assembly may also include a first pump and a second pump, each of which can selectively activate the displacement unit. The method can also include characterizing the first and second pumps to determine performance characteristics of the first and second pumps under a plurality of predefined operating conditions. As part of the method, the sensor can be calibrated prior to positioning the downhole tool in a borehole and while the downhole tool is positioned in the borehole. Additionally, the method can also include calibrating the second pump while the downhole tool is positioned in the borehole.

In yet another embodiment, a method includes providing a pump assembly that includes a displacement unit that has a piston with a first piston head positioned in a first cylinder, a second piston head positioned in a second cylinder, and a sensor. The pump assembly can also include first and second pumps that selectively activate the displacement unit. The method can also include monitoring a signal produced by the sensor and determining the position of the piston using the signal produced by the sensor. Using the position of the piston, at least one of the first and second pumps can be calibrated.

Additional features and advantages of implementations of the disclosure will be set forth in the description which follows, and in part will be apparent from the description, or may be learned by the practice of such implementations. The features and advantages of such implementations may be realized and obtained by means of the instruments and combinations particularly pointed out in the appended claims. These and other features will become more fully apparent from the following description and appended claims, or may be learned by the practice of such implementations as set forth hereinafter.

BRIEF DESCRIPTION OF THE DRAWINGS

In order to describe the manner in which the above-recited and other advantages and features of the disclosure can be obtained, a more particular description will be rendered by reference to specific embodiments thereof which are illustrated in the appended drawings. For better understanding, the like elements have been designated by like reference numbers throughout the various accompanying figures. Understanding that these drawings depict typical embodiments of the disclosure and are not therefore to be considered to be limiting of its scope, the embodiments will be described and explained with additional specificity and detail through the use of the accompanying drawings in which.

DETAILED DESCRIPTION

Figure 1:
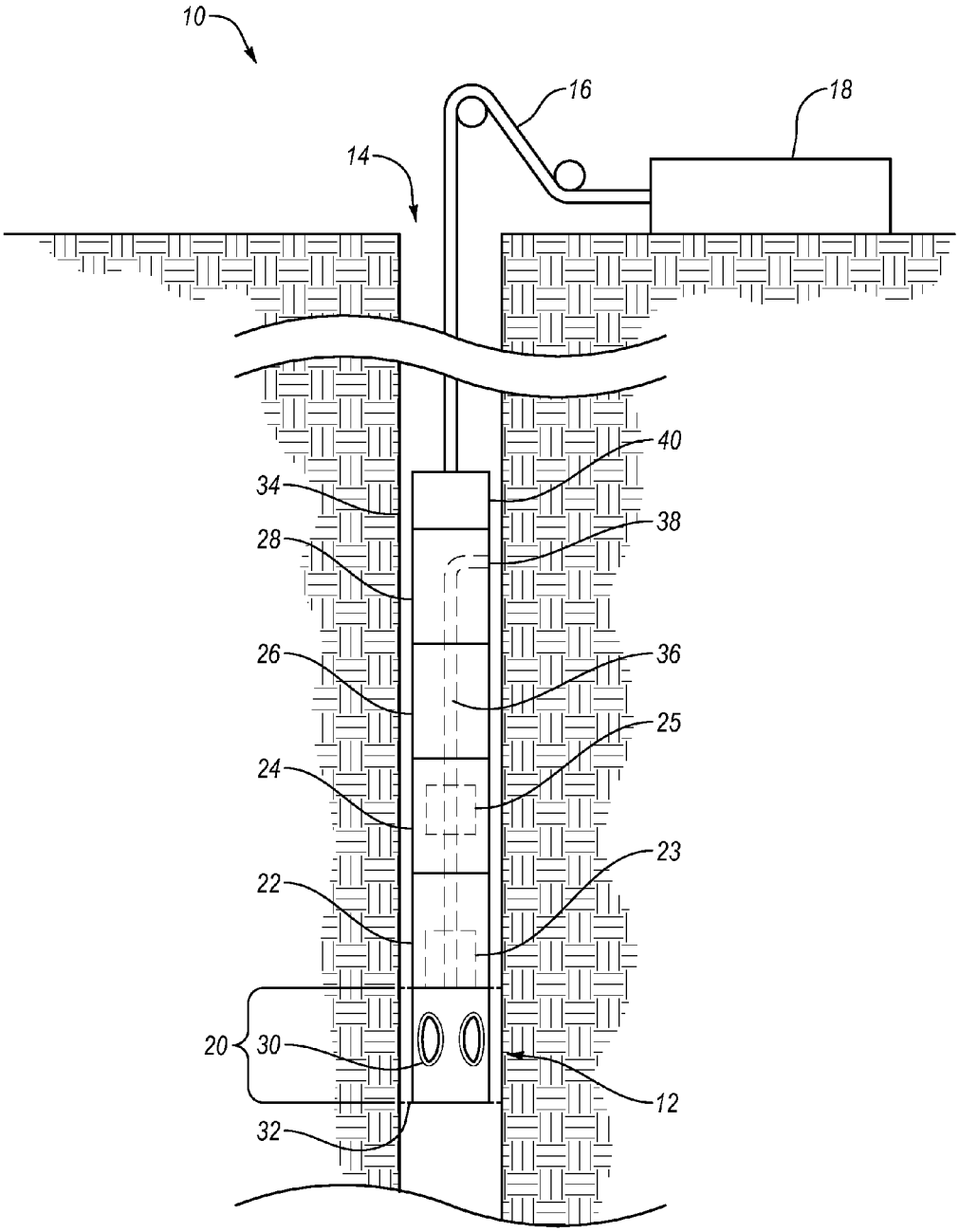
FIG. 1 is a side partial cross-section view of a well and a wireline system with a formation testing system in accordance with one or more embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals in the various examples. This repetition is for the purpose of simplicity and clarity and does not in itself dictate a relationship between the various embodiments and/or configurations discussed.

Those skilled in the art, given the benefit of this disclosure, will appreciate that the disclosed apparatuses and methods have applications in operations other than drilling and that drilling may not performed in connection with one or more aspects or embodiments of the present disclosure. While this disclosure is described in relation to sampling, the disclosed apparatus and method may be applied to other operations including injection techniques.

The systems and methods of the present disclosure may be used or performed in connection with formation evaluation while drilling processes. The phrase "formation evaluation while drilling" refers to various sampling and testing operations that may be performed during the drilling process, such as sample collection, fluid pump out, pretests, pressure tests, fluid analysis, and resistivity tests, among others. It will be understood that the measurements made during "formation evaluation while drilling" may be made while a drill bit is not actually cutting through a formation. For example, sample collection and pump out may be performed during brief stops in the drilling process. That is, the rotation of the drill bit is briefly stopped so that the measurements may be made. Drilling may continue once the measurements are made. Even in embodiments where measurements are made after drilling is stopped, the measurements may still be made without having to trip the drill string.

In this disclosure, "hydraulically coupled" or "hydraulically connected" and similar terms may be used to describe bodies that are connected in such a way that fluid pressure may be transmitted between and among the connected items. The term "in fluid communication" is used to describe bodies that are connected in such a way that fluid can flow between and among the connected items. It is noted that hydraulically coupled or connected may include certain arrangements where fluid may not flow between the items, but the fluid pressure may nonetheless be transmitted. Thus, fluid communication is a subset of hydraulically coupled.

FIG. 1 depicts a system 10 in accordance with an embodiment of the present disclosure. While certain elements of the system 10 are depicted in this figure and generally discussed below, it will be appreciated that the wireline system 10 may include other components in addition to, or in place of, those presently illustrated and discussed. As depicted, the system 10 includes a sampling tool 12 suspended in a well 14 from a cable 16. The cable 16 may be a wireline cable that may support the sampling tool 12 and may include at least one conductor that enables data communication between the sampling tool 12 and a control and monitoring system 18 disposed on the surface.

The cable 16, and hence the sampling tool 12, may be positioned within the well in any suitable manner. As an example, the cable 16 may be connected to a drum, allowing rotation of the drum to raise and lower the sampling tool 12. The drum may be disposed on a service truck or a stationary platform. The service truck or stationary platform may further contain the control and monitoring system 18. The control and monitoring system 18 may include one or more computer systems or devices and/or may be a distributed computer system. For example, collected data may be stored, distributed, communicated to an operator, and/or processed locally or remotely. The control and monitoring system 18 may, individually or in combination with other system components, perform the methods discussed below, or portions thereof.

The sampling tool 12 may include multiple components. For example, the illustrated sampling tool 12 includes a probe module 20, a fluid analysis module 22, a pump-out module 24, a power module 26, and a fluid sampling module 28. However, in further embodiments, the sampling tool 12 may include additional or fewer components.

The probe module 20 of the sampling tool 12 includes one or more inlets 30 that may engage or be positioned adjacent to the wall 34 of the well 14. The one or more inlets 30 may be designed to provide focused or un-focused sampling. Furthermore, the probe module 20 also includes one or more deployable members 32 configured to place the inlets 30 into engagement with the wall 34 of the well 14. For example, as shown in FIG. 1, the deployable member 32 includes an inflatable packer that can be expanded circumferentially around the probe module 20 to extend the inlets 30 into engagement with the wall 34. In another embodiment, the one or more deployable members 32 may be one or more setting pistons that may be extended against one or more points on the wall 34 of the well 14 to urge the inlets 30 against the wall. In yet another embodiment, the inlets 30 may be disposed on one or more extendable probes designed to engage the wall 34.

The pump-out module 24 includes a pump assembly 25 that draws sample fluid through a flow line 36 within the sampling tool 12. In the illustrated embodiment, the flow line 36 provides fluid communication between the one or more inlets 30 and the outlet 38. As shown in FIG. 1, the flow line 36 extends through the probe module 20 and the fluid analysis module 22 before reaching the pump-out module 24. However, in other embodiments, the arrangement of the modules 20, 22, and 24 may vary. For example, in certain embodiments, the fluid analysis module 22 may be disposed on the other side of the pump-out module 24. Likewise, the flow line 36 may also extend through the power module 26 and the fluid sampling module 28 before reaching the outlet 38.

The fluid sampling module 28 may selectively retain some fluid for storage and transport to the surface for further evaluation outside the borehole. In some embodiments, the fluid analysis module 22 may include a fluid analyzer 23 that can be employed to provide in situ downhole fluid evaluations. For example, the fluid analyzer 23 may include a spectrometer and/or a gas analyzer designed to measure properties such as, optical density, fluid density, fluid viscosity, fluid fluorescence, fluid composition, and the fluid gas-oil ratio, among others. According to certain embodiments, the spectrometer may include any suitable number of measurement channels for detecting different wavelengths, and may include a filter-array spectrometer or a grating spectrometer. For example, the spectrometer may be a filter-array absorption spectrometer having ten measurement channels. In other embodiments, the spectrometer may have sixteen channels or twenty channels, and may be provided as a filter-array spectrometer or a grating spectrometer, or a combination thereof (e.g., a dual spectrometer). According to certain embodiments, the gas analyzer may include one or more photodetector arrays that detect reflected light rays at certain angles of incidence. The gas analyzer also may include a light source, such as a light emitting diode, a prism, such as a sapphire prism, and a polarizer, among other components. In certain embodiments, the gas analyzer may include a gas detector and one or more fluorescence detectors designed to detect free gas bubbles and retrograde condensate liquid drop out.

One or more additional measurement devices, such as temperature sensors, pressure sensors, viscosity sensors, chemical sensors (e.g., for measuring pH or $H_2S$ levels), and gas chromatographs, may also be included within the fluid analyzer 23. Further, the fluid analyzer 23 may include a resistivity sensor and a density sensor, which, for example, may be a densimeter or a densitometer. In certain embodiments, the fluid analysis module 22 may include a controller, such as a microprocessor or control circuitry, designed to calculate certain fluid properties based on the sensor measurements. Further, in certain embodiments, the controller may govern sampling operations based on the fluid measurements or properties. Moreover, in other embodiments, the controller may be disposed within or constitute another module of the downhole tool 12. For instance, the fluid sampling tool 12 may include a downhole controller 40 that may include one or more computer systems or devices and/or may be part of a distributed computer system. The downhole controller 40 may, individually or in combination with other system components (e.g., control and monitoring system 18), perform the methods discussed below, or portions thereof.

Figure 2:
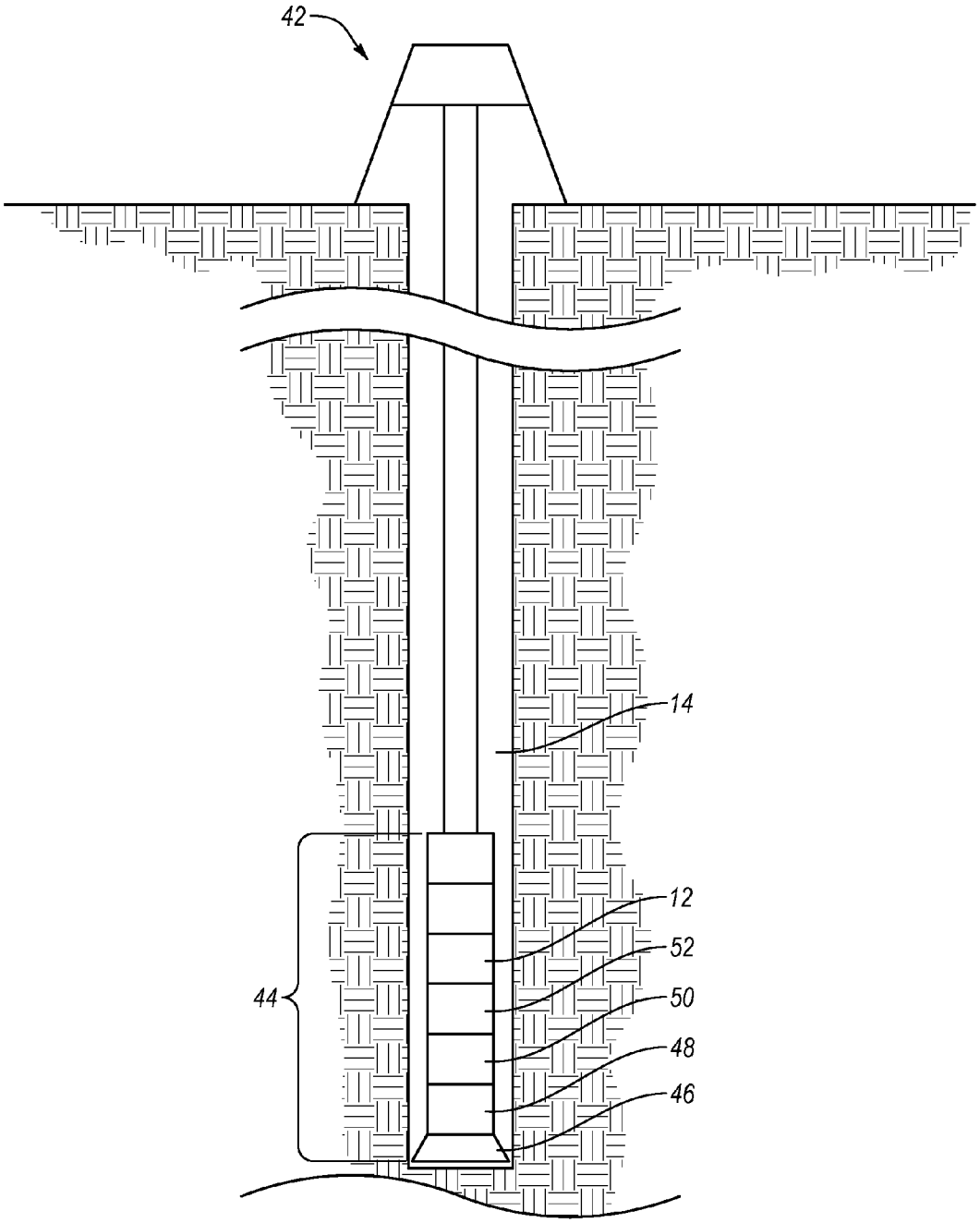
FIG. 2 is a side partial cross-section view of a well and drill string with a formation testing system in accordance with one or more embodiments of the present disclosure.

While FIG. 1 illustrates sampling being conducted with a wireline system, it will be appreciated that other embodiments are contemplated. For instance, in other embodiments, the sampling tool 12 may be a portion of a drilling system 42, as shown in FIG. 2. The drilling system 42 includes a bottomhole assembly 44 that includes data collection modules. For example, in addition to the drill bit 46 and steering module 48 for manipulating the orientation of the drill bit 46, the bottomhole assembly 44 includes a measurement-while-drilling (MWD) module 50 and a logging-while-drilling (LWD) module 52. The MWD module 50 is capable of collecting information about the rock and formation fluid properties within the well 14, and the LWD module 52 is capable of collecting characteristics of the bottomhole assembly 44 and the well 14, such as orientation (azimuth and inclination) of the drill bit 46, torque, shock and vibration, the weight on the drill bit 46, and downhole temperature and pressure. The MWD module 50 may be capable, therefore, of collecting real-time data during drilling that can facilitate formation analysis. Additionally, although depicted in an onshore well 14, wireline system 10 and drilling system 42 could instead be deployed in an offshore well. Further, in yet other embodiments, the sampling tool 12 may be conveyed within a well 14 on other conveyance means, such as wired drill pipe, or coiled tubing, among others.

Figure 3:
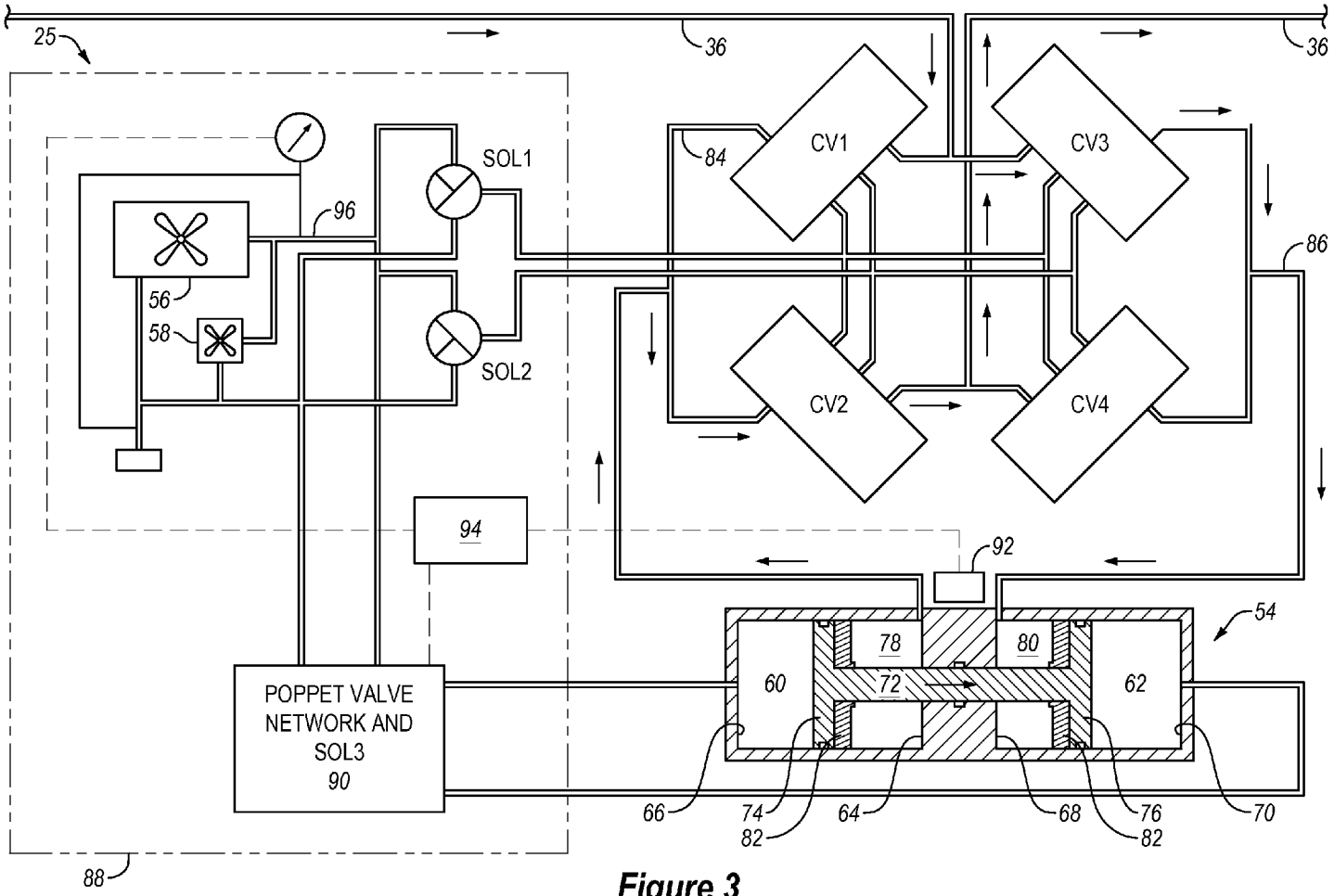
FIG. 3 is a schematic view of a pump assembly according to one or more embodiments of the present disclosure.
Figure 4:
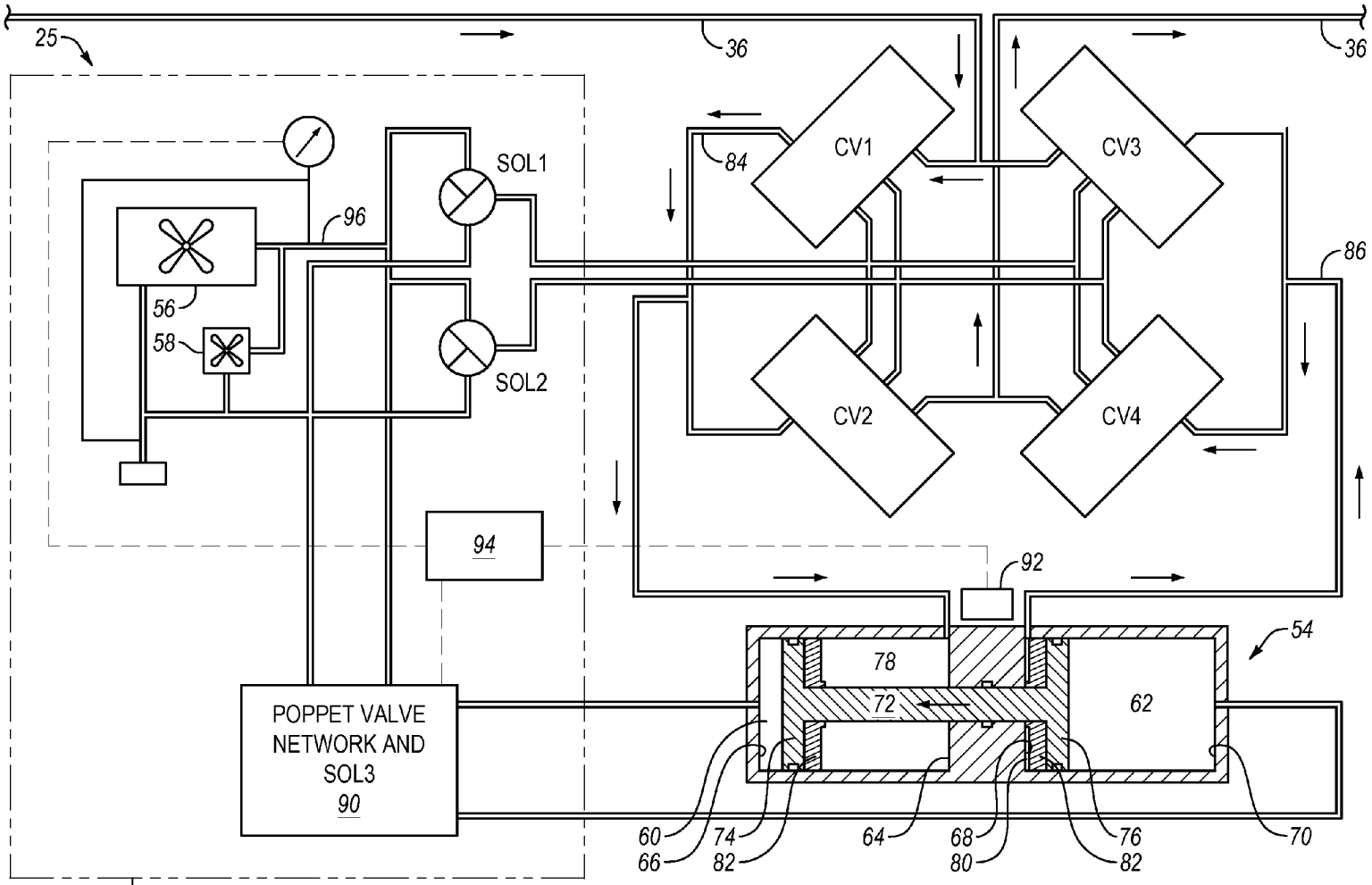
FIG. 4 is another schematic view of the pump assembly of FIG. 3.

FIGS. 3 and 4 are schematic illustrations of an example pump assembly 25 for use in the pump-out module 24 (see FIG. 1). As alluded to elsewhere herein, pump-out module 24 may be used to: dispose of unwanted fluid samples by virtue of pumping fluid through flow line 36 into the borehole through outlet 38; draw formation fluid from the borehole or formation into flow line 36 via probe module 20; or pump the formation fluid into one or more sample chambers in fluid sample module 28. In other words, pump-out module 24 is useful for pumping fluids into, out of, and (axially) through the downhole tool 12.

In the illustrated embodiment, the pump assembly 25 includes a positive displacement, two-stroke piston pump 54 (also referred to herein as a displacement unit 54), which is energized by hydraulic fluid from a first pump 56 and/or a second pump 58. The displacement unit 54 may include a first cylinder 60 and a second cylinder 62. The first cylinder 60 is formed between an end wall 64 and a distal wall 66. Similarly, the second cylinder 62 is formed between an end wall 68 and a distal wall 70. The piston 72 includes a first head 74 disposed in the first cylinder 60 and a second head 76 disposed in the second cylinder 62. A first chamber 78 is formed between the piston head 74 and the end wall 64 and a second chamber 80 is formed between the piston head 76 and the end wall 68. For purposes described in greater detail below, one or both of the piston heads 74, 76 may include detectable features, such as magnets 82 or the like.

The piston 72 is movable within the displacement pump in first and second stroke directions of a two-stroke piston pump cycle. For instance, as shown in FIG. 3, the piston 72 is moving from left to right in a first stroke direction. Conversely, as shown in FIG. 4, the piston 72 can move from right to left in a second stroke direction. It will be understood that "left to right," "right to left, and "first" and "second" stroke directions are arbitrary designations. Thus, for instance, a first stroke direction may be when the piston 72 is moving from right to left and a second stroke direction may be when the piston 72 is moving from left to right. Similarly, the displacement unit 54 may be oriented such that the piston 72 moves up and down or in other directions (e.g., diagonally) during its strokes. In any event, the piston 72 may complete a full stroke when the piston 72 travels a distance that is substantially equal to the distance between the end wall 64 and the distal wall 66 or between the end wall 68 and the distal wall 70.

As illustrated in FIGS. 3 and 4, the pump assembly 25 employs control valve settings and flow directions according to first and second respective strokes of the two-stroke piston pump cycle according to one or more aspects of the present disclosure. The depicted pump assembly 25 includes a first flow line 84 equipped with a pair of control valves CV1, CV2 for selectively communicating fluid to or from the displacement unit 54 and a second flow line 86 equipped with a pair of control valves CV3, CV4 for selectively communicating fluid to or from the displacement unit 54. More specifically, the first flow line 84 and the control valves CV1, CV2 selectively communicate fluid from the flow line 36 to the first chamber 78 of the displacement unit 54, and the second flow line 86 and the control valves CV3, CV4 selectively communicate fluid from the flow line 36 to the second chamber 80 of the displacement unit 54.

Hydraulic fluid is directed by the first and/or second hydraulic pumps 56, 58 through solenoids SOL1 and SOL2, which form part of a control system 88 for the pump assembly 25, to control the operation of valves CV1-CV4. Control valves CV1-CV4 may be passive valves (e.g., check valves) or active valves. In an active system, control valves CV1-CV4 are operated between open and closed positions, for example via control system 88 and solenoids SOL1 and SOL2. In a passive system, solenoids SOL1 and SOL2 may be utilized, for example, to shift check slides to set the bias of the check valve CV1-CV4. Passive valves ensure that fluid flows through the control valves when the direction (e.g., stroke) of piston 72 reverses. A sufficient fluid-flowing pressure may be maintained in lines 84, 86 to overcome the biasing force of the respective passive control valves CV1-CV4. Solenoid SOL3 and the associated poppet valve network 90 are provided to reciprocate central hydraulic piston 72 of the displacement unit 54.

The control system 88 may include one or more sensors 92 to detect the position of the piston 72. The one or more sensors 92 may include a Hall Effect sensor, a giant magnetoresistance (GMR) sensor, or any other sensor that can detect the magnetic field produced by the magnets 82 on the piston 72. The control system 88 may also include system electronics 94 that automatically command the solenoids to selectively deliver hydraulic fluid via one or both of the first and second hydraulic pumps 56, 58 to achieve the proper settings for control valves CV1-CV4. Thus, the control system 88 is operable to synchronize the operation of the displacement unit 54 with the control valves CV1-CV4, such that each control valve is commanded to open or close (e.g., active control valves) or is biased for flow in a desired direction (e.g., passive) at or near the time that the piston 72 completes each of its two strokes.

Continuously or frequently monitoring the position of the piston 72 within the displacement unit 54 (e.g., by way of sensor(s) 92 and the system electronics 94) may provide a number of advantages. By way of example, monitoring the position of the piston 72 allows for the "dead volume" within the chambers 78, 80 to be minimized without the risks associated with high force impacts between the piston heads 74, 76 and the walls 64, 66, 68, 78. Additionally, monitoring the position of the piston 72 can allow for smooth and controlled transitions between the first stroke direction and the second stroke direction, thereby allowing for shorter interruptions to fluid flow. Furthermore, knowing the position of the piston 72 can allow for more accurate monitoring of the flow and volume rates of the fluid within the pump assembly 25.

According to one or more aspects of the present disclosure, the pump assembly 25 may monitor the position of the piston 72 (e.g., via sensor(s) 92 and the system electronics 94) to, for example, determine when the piston 72 is nearing the end of a stroke. When the sensor(s) 92 detect that the piston is nearing the end of a stroke, the system electronics 94 may actuate the solenoid SOL3 and one or both of the first and second pumps 56, 58 to smoothly reverse the stroke direction of piston 72, while maximizing the stroke length without high force impacts and minimizing the dead volume. As shown in FIGS. 3 and 4, the hydraulic circuit 96 (e.g., flow line) provides the hydraulic fluid from the first and second pumps 56, 58 to energize the displacement unit 54.

Accordingly, FIGS. 1-4 and the corresponding text provide a number of different components and mechanisms for pumping fluids into, out of, and through a device, such as the downhole tool 12. The foregoing also provides components and mechanisms for monitoring and controlling the operation of a pump assembly, and, more particularly, a displacement unit thereof. In order to accurately control the operation of the pump assembly, the pump assembly 25 may need to be calibrated.

Figure 5:
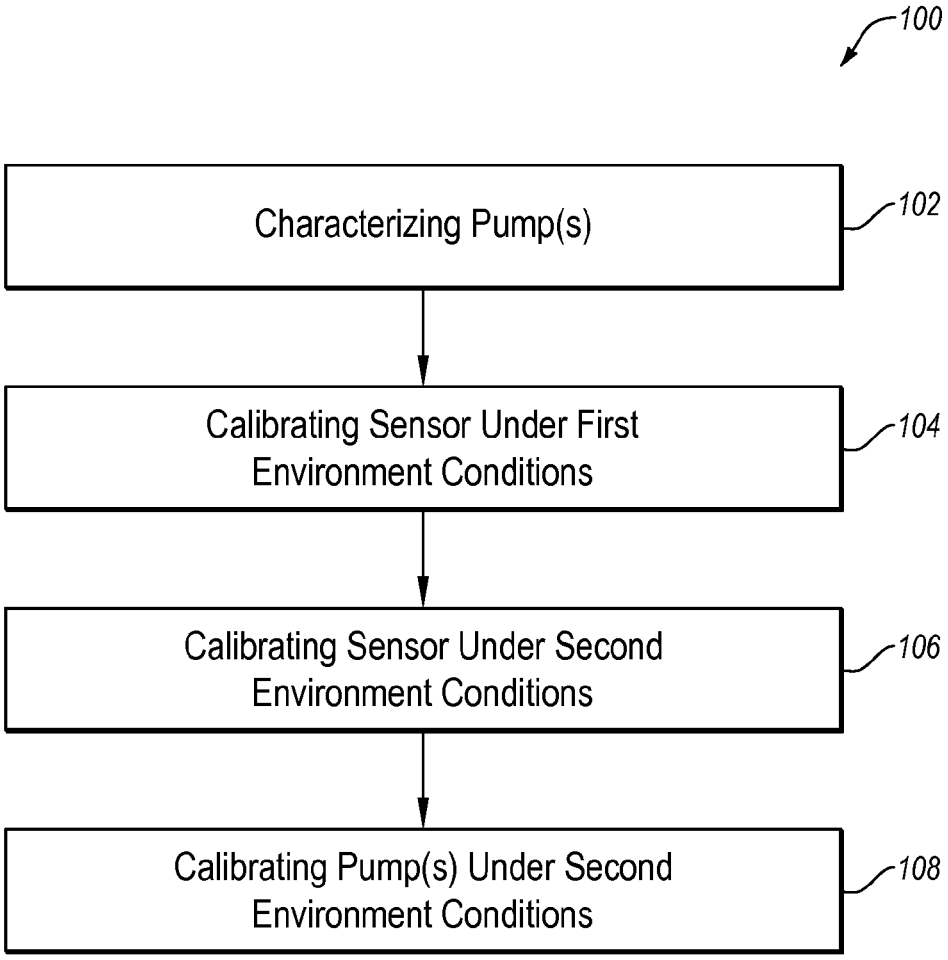
FIG. 5 is a flowchart depicting a method in accordance with one or more embodiments of the present disclosure.
Figure 9:
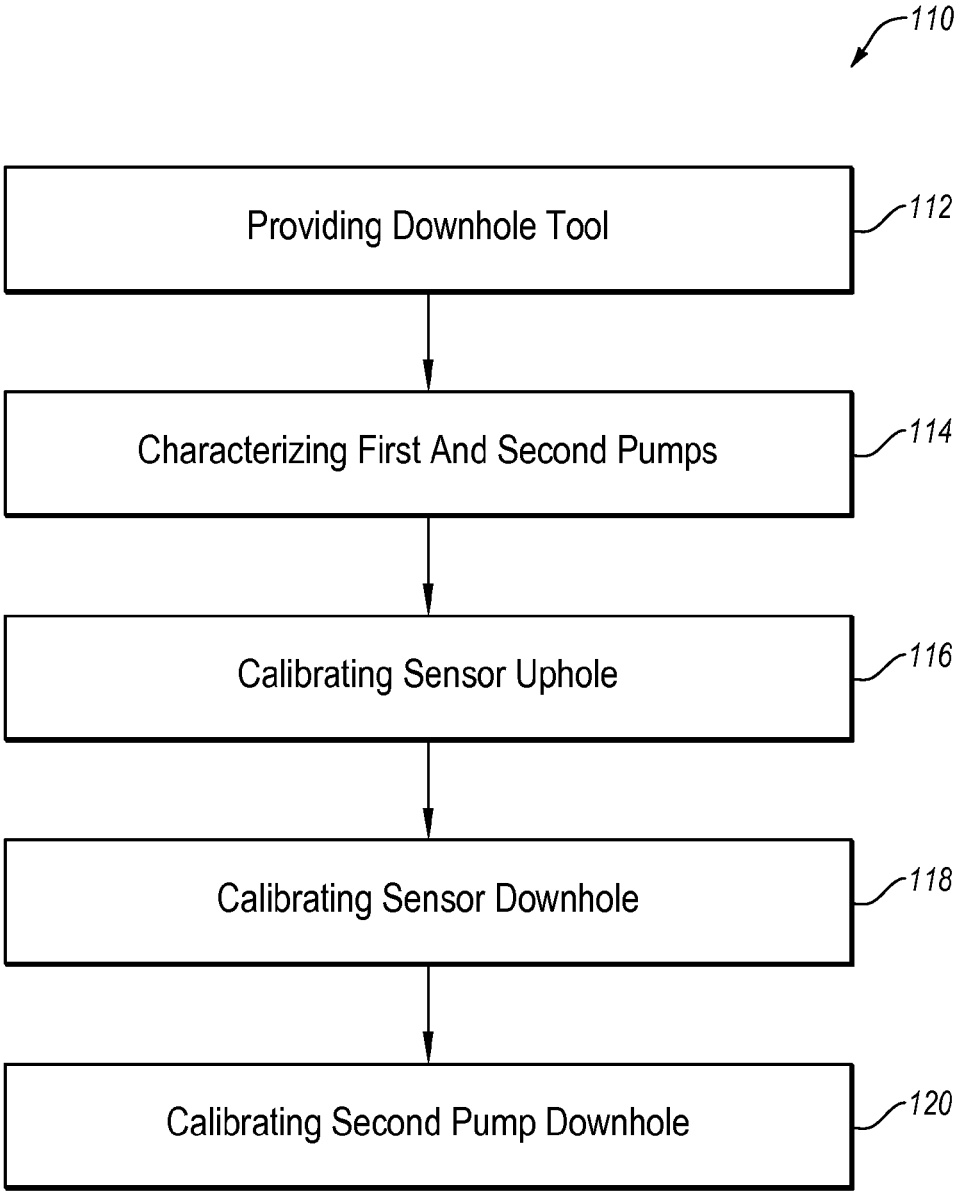
FIG. 9 is a flowchart depicting another method in accordance with one or more embodiments of the present disclosure.
Figure 10:
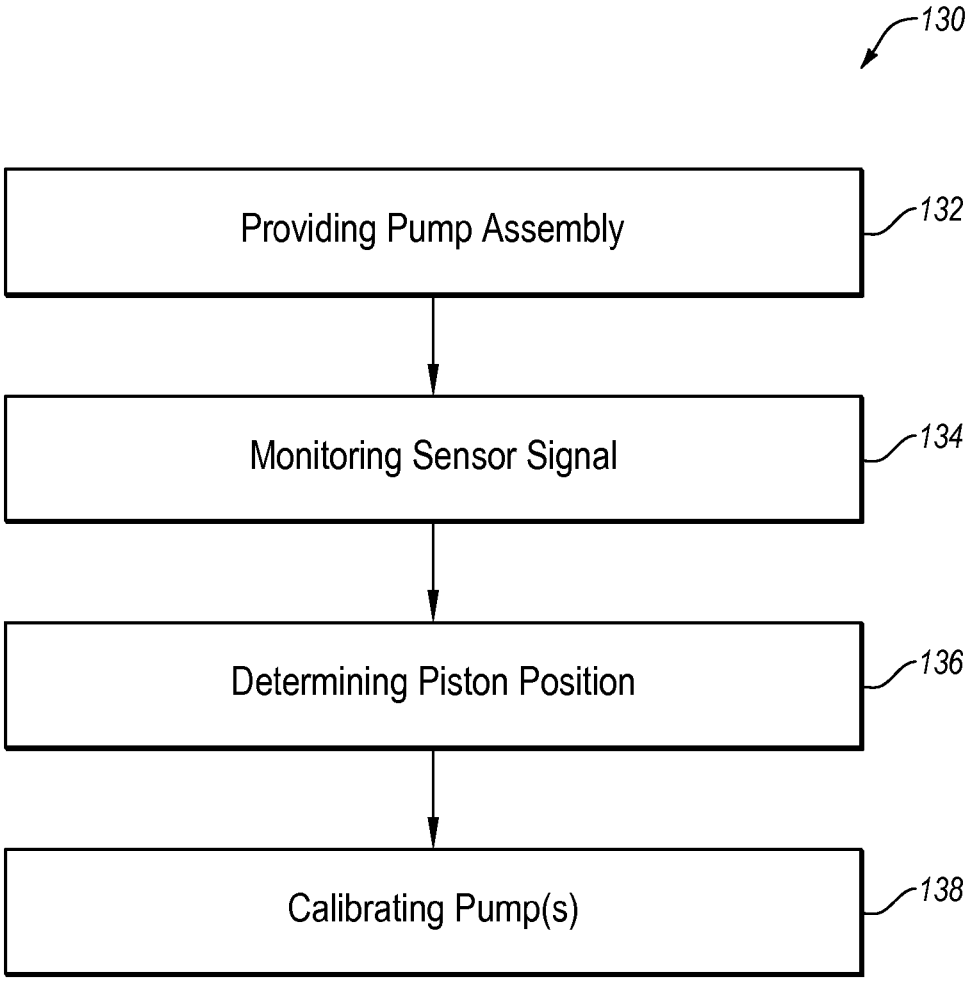
FIG. 10 is a flowchart depicting yet another method in accordance with one or more embodiments of the present disclosure.

Accordingly, implementations of the present disclosure include methods for calibrating and/or operating a pump assembly. For example, FIGS. 5, 9, and 10 illustrate flowcharts of methods for calibrating and operating a pump assembly using principles of the present disclosure. While the methods of FIGS. 5, 9, and 10 are described below with reference to the components and diagrams of FIGS. 1-4, it will be appreciated that the methods may be performed without the components of FIGS. 1-4 or with other components. Additionally, it should be understood that although each method is described as having a particular order, portions of the methods may be performed simultaneously or in other orders. It will also be appreciated that some aspects of the described methods may not be used in each implementations of the present disclosure.

Accordingly, the present disclosure includes a method 100, depicted in FIG. 5, for calibrating a pump assembly (25) that includes a displacement unit (54) and one or more pumps (56, 58) that activate the displacement unit. According to the illustrated embodiment, the method 100 includes characterizing the one or more pumps to determine one or more performance characteristics of the one or more pumps 102 (also referred to herein as the initial pump calibration process 102). The one or more performance characteristics determined during the characterization of the one or more pumps may include the pump volumetric efficiency of each of the one or more pumps or the combined pump volumetric efficiency of the one or more pumps. Thus, for example, characterizing the one or more pumps may include individually characterizing a first pump of the one or more pumps and characterizing a second pump of the one or more pumps. In other embodiments, characterizing the one or more pumps may include characterizing first and second pumps of the one or more pumps together.

Characterizing the one or more pumps to determine one or more performance characteristics of the one or more pumps may include one or more aspects. For instance, characterizing the one or more pumps may include operating the one or more pumps under a plurality of predefined operating conditions. Characterizing the one or more pumps may also include determining one or more performance characteristics of the one or more pumps based on the operation of the one or more pumps under each of the plurality of predefined operating conditions. Furthermore, characterizing the one or more pumps may include generating one or more data curves of the one or more performance characteristics of the one or more pumps for each of the plurality of predefined operating conditions.

The plurality of predefined operating conditions at which the one or more pumps are operated during the characterization process may include at least two fluid viscosities, at least two operating pressures, and/or at least two operating speeds. Operating the one or more pumps under various predefined operating conditions provides data about how the one or more pumps perform under the various predefined operating conditions. This data, alone or in combination with other data, can be used when the one or more pumps are operated in actual operating conditions (e.g., in a well) to determine the operation characteristics or performance of the pump assembly. For instance, the data can be used to estimate fluid flow rates and volume levels. The data can also be used to adjust flow rate estimates based on the actual operating conditions (e.g., downhole conditions), such as actual pressure, speed, and viscosity. Furthermore, the data can be used to determine error estimations for fluid flow rates as a result of pressure and speed variations.

The method 100 may also include calibrating a sensor (92) associated with the displacement unit (54) under operating conditions of a first environment 104 (also referred to herein as first sensor calibration process 104). The first environment may be, for example, at the Earth's surface near the opening of a well. Calibrating the sensor under operating conditions of the first environment may include moving the piston (72) in a first stroke direction until the piston reaches an end of a first stroke, and moving the piston of the displacement unit in a second stroke direction through a known stroke length. In some embodiments, moving the piston in the second stroke direction through a known stroke length may include moving the piston in the second stroke direction until the piston reaches an end of a second stroke.

As the piston (72) moves in the first stroke direction until reaching the end of the first stroke, the sensor (92) detects the changing magnetic field produced by the magnets (82) on the piston. When the sensor detects that the magnetic field is no longer changing, it is known that the piston has reached the end of the first stroke. Thereafter, the piston can be moved in the second stroke direction. As the piston moves in the second stroke direction, the sensor again detects the changing magnetic field produced by the magnets. As before, when the sensor detects that the magnetic field is no longer changing, it is known that the piston has reached the end of the second stroke. As the piston moves through the first and second strokes and the sensor detects the changing magnetic field, the sensor produces a signal that may be representative of the magnetic field produced by the magnets.

Figure 6:
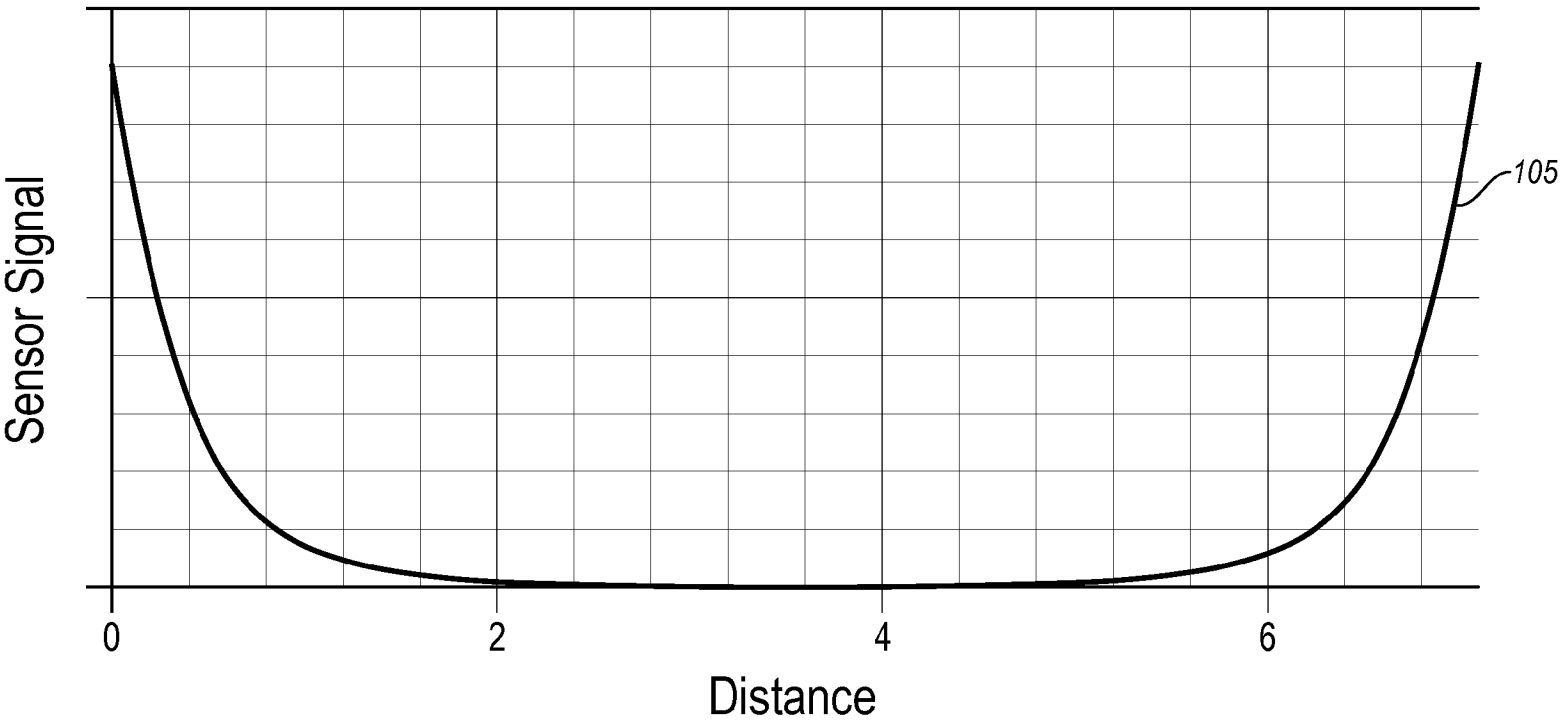
FIGS. 6-8 illustrate position-signal curves in accordance with one or more embodiments of the present disclosure.

The signal produced by the sensor (92) may be correlated with the position of the piston (72) to produce a position-signal look-up table and/or a position-signal curve. In some embodiments, the operating parameters of the one or more pumps (56, 58) during the calibration of the sensor are used to correlate the sensor signal with the position of the piston. For example, during movement of the piston in the second stroke direction, an operating parameter of the one or more pumps and the signal produced by the sensor can be monitored. Using data collected during the characterization of the one or more pumps, the monitored operating parameter of the one or more pumps may be correlated to the sensor signal in order to generate the position-signal look-up table and/or a position-signal curve. FIG. 6 illustrates an example position-signal curve 105 generated from the data collected during the first sensor calibration process 104.

The method 100 may also include calibrating the sensor (92) associated with the displacement unit (54) under operating conditions of a second environment 106 (also referred to herein as second sensor calibration process 106). The second environment may be, for example, in a borehole. The process for calibrating the sensor under operating conditions of the second environment may be similar or identical to the process for calibrating the sensor under operating conditions of the first environment. For instance, calibrating the sensor under operating conditions of the second environment may include moving the piston (72) in a first stroke direction until the piston reaches an end of a first stroke, and moving the piston of the displacement unit in a second stroke direction through a known stroke length. In some embodiments, moving the piston in the second stroke direction through a known stroke length may include moving the piston in the second stroke direction until the piston reaches an end of a second stroke.

As before, the sensor (92) detects the changing magnetic field produced by the magnets (82) on the piston (72) as the piston moves in the first stroke direction until reaching the end of the first stroke. When the sensor detects that the magnetic field is no longer changing, it is known that the piston has reached the end of the first stroke. Thereafter, the piston can be moved in the second stroke direction. As the piston moves in the second stroke direction, the sensor again detects the changing magnetic field produced by the magnets. As before, when the sensor detects that the magnetic field is no longer changing, it is known that the piston has reached the end of the second stroke. As the piston moves through the first and second strokes and the sensor detects the changing magnetic field, the sensor produces a signal that may be representative of the magnetic field produced by the magnets.

Figure 7:
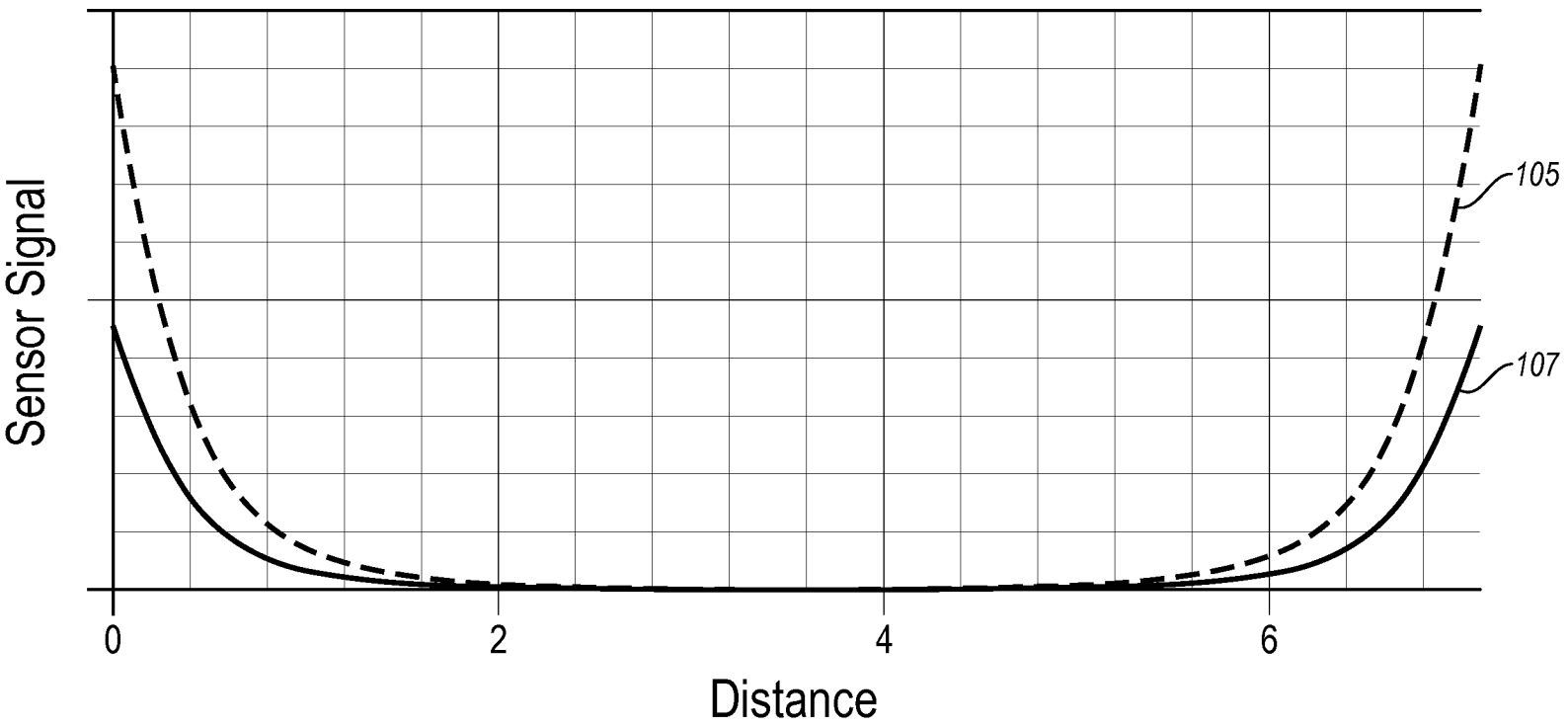

As with the first sensor calibration process 104, the signal produced by the sensor (92) during the second sensor calibration process 106 may be correlated with the position of the piston (72) to produce a position-signal look-up table and/or a position-signal curve. In some embodiments, the operating parameters of the one or more pumps (56, 58) during the calibration of the sensor are used to correlate the sensor signal with the position of the piston. For example, during movement of the piston in the second stroke direction, an operating parameter of the one or more pumps and the signal produced by the sensor can be monitored. Using data collected during the characterization of the one or more pumps, the monitored operating parameter of the one or more pumps may be correlated to the sensor signal in order to generate the position-signal look-up table and/or a position-signal curve. FIG. 7 illustrates an example position-signal curve 107 generated from the data collected during the second sensor calibration process 106 overlaid on the position-signal curve 105 generated from the data collected during the first sensor calibration process 104.

The method 100 may also include calibrating the one or more pumps (56, 58) under operating conditions of the second environment to determine one or more performance characteristics of the one or more pumps at the operating conditions of the second environment 108 (also referred to herein as the second pump calibration process 108). Such calibration of the one or more pumps may include operating a first pump of the one or more pumps to move the piston (72) from a first known position to a second known position. At least one of the first and second known positions may be determined from the signal produced by the sensor (92).

Figure 8:
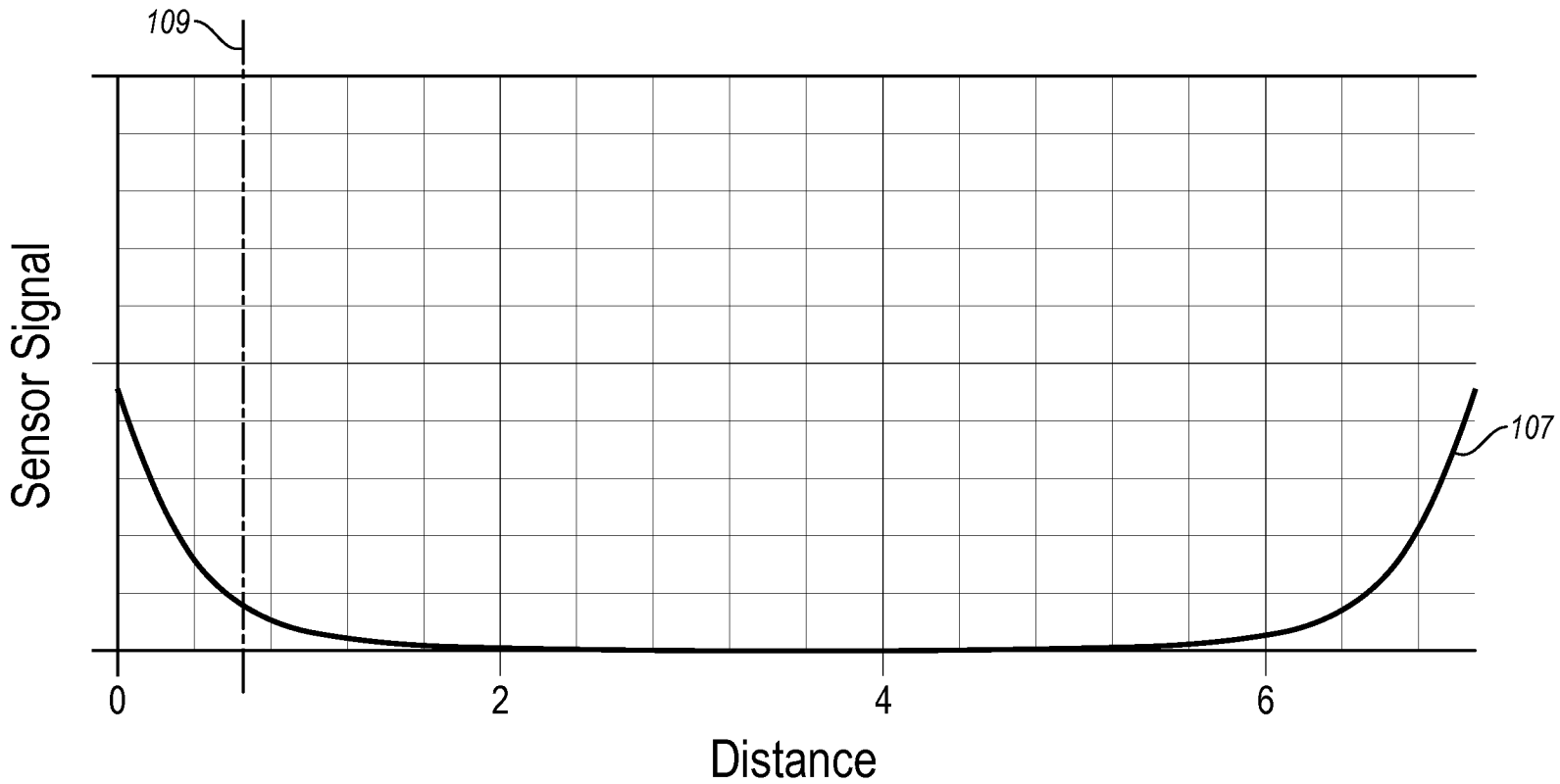

By way of illustration, with the piston (72) positioned at an end of a stroke (e.g., the first known position), a first pump may be operated to move the piston to a second position (e.g., the second known position) that can be determined from the above-described position-signal curve 107 or related look-up table. For instance, as shown in FIG. 8, the piston can be moved (via operation of the first pump) from the end of a stroke (corresponding to the left end of the graph) to a second position indicated by line 109. The position of the piston as indicated by line 9 can be determined by measuring the magnetic field produced by the magnets (82) and finding the corresponding magnetic field value on the position-signal curve 107. The second pump calibration process (108) may also include monitoring operation of the first pump and the time it takes to move the piston from the first known position to the second known position. Thereafter, the piston can be moved (via operation of the second pump) from the second known position to the first known position while monitoring the operation of the second pump and the time it takes to move the piston from the second known position to the first known position. Using the data determined during one or more of the processes 102, 104, 106 and the data determined during the second pump calibration process 108, the operation of the one or more pumps can be calibrated for operation in the second environment.

In another embodiment, as depicted in FIG. 9, a method 110 is provided. As illustrated, the method may include providing a downhole tool 112. The downhole tool (12) may include a pump assembly (25) that has a displacement unit (54). The displacement unit may include a piston (72) with a first piston head (74) positioned in a first cylinder (60), a second piston head (76) positioned in a second cylinder (62), and a sensor (92) that detects the position of the piston. The pump assembly may also include a first pump that selectively activates the displacement unit, and a second pump that selectively activates the displacement unit.

The method 110 may also include characterizing the first and second pumps (56, 58) to determine performance characteristics of the first and second pumps under a plurality of predefined operating conditions 114. Characterizing the first and second pumps may be performed in a manner that is similar or identical to that described above in connection with the initial pump calibration process 102 of method 100.

The method 110 may also include calibrating the sensor (92) prior to positioning the downhole tool in a borehole 116

(also referred to herein as calibrating the sensor uphole 116) and calibrating the sensor while the downhole tool is positioned in the borehole 118 (also referred to herein as calibrating the sensor downhole 118). The processes for calibrating the sensor uphole 116 can be similar or identical to the first sensor calibration process 104 described above in connection with method 100.

For instance, calibrating the sensor prior to positioning the downhole tool in the borehole may include moving the piston (72) from a first known position, through a full stroke length to a second known position, and monitoring a signal produced by the sensor (92) during movement of the piston through the full stroke length. Likewise, the processes for calibrating the sensor downhole 118 can be similar or identical to the second sensor calibration process 106 described above in connection with method 100. For instance, calibrating the sensor while the downhole tool is positioned in the borehole may include moving the piston from a first known position, through a full stroke length to a second known position, and monitoring a signal produced by the sensor during movement of the piston through the full stroke length.

The method 110 may also include calibrating the second pump while the downhole tool (12) is positioned in the borehole 120. The process for calibrating the second pump while the downhole tool is positioned in the borehole can be similar or identical to the second pump calibration process (108) described above in connection with method 100. For instance, calibrating the first pump while the downhole tool is positioned in the borehole may include operating the first and second pumps to move the piston to a known intermediate position determined by a signal produced by the sensor, and operating the second pump to move the piston from the know intermediate position to an end of a stroke.

FIG. 10 illustrates another method 130 according to the present disclosure. The method 130 may include providing a pump assembly 132. The pump assembly (25) may include a displacement unit (54) that includes a piston (72) having a first piston head (74) positioned in a first cylinder (60), a second piston head (76) positioned in a second cylinder (62), and a sensor (92). The pump assembly may also include a first pump that selectively activates the displacement unit, and a second pump that selectively activates the displacement unit.

The method 130 may also include monitoring a signal produced by the sensor 134. Using the signal produced by the sensor (92), the method 130 may include determining the position of the piston 136. Additionally, the method 130 may include calibrating at least one of the first and second pumps using the position of the piston 138. The process for calibrating at least one of the first and second pumps using the position of the piston may include operating one of the first and second pumps to move the piston from a first known position to a second known position. At least one of the first and second known positions may be determined from the signal produced by the sensor. The process for calibrating at least one of the first and second pumps may also include monitoring the time it takes to move the piston from the first known position to the second known position.

In some embodiments, the method 130 may also include characterizing the first and second pumps to determine performance characteristics of the first and second pumps under a plurality of predefined operating conditions. The characterization of the first and second pumps may be performed prior to the monitoring of the sensor signal. As discussed above, the characterization of the first and second pumps may be performed individually or in combination. Furthermore, the characterization of the first and second pumps may include operating one or both of the first and second pumps at various fluid viscosities, operating pressures, and/or operating speeds.

One or more specific embodiments of the present disclosure have been described herein. These described embodiments are examples of the presently disclosed techniques. Additionally, in an effort to provide a concise description of these embodiments, some features of an actual implementation may not be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The terms "approximately," "about," and "substantially" as used herein represent an amount close to the stated amount that still performs a desired function or achieves a desired result. For example, the terms "approximately," "about," and "substantially" may refer to an amount that is within less than 10% of, within less than 5% of, within less than 1% of, within less than 0.1% of, and within less than 0.01% of a stated amount.

The present disclosure may be embodied in other specific forms without departing from its spirit or basic characteristics. The described embodiments are to be considered in as illustrative and not restrictive. The scope of the disclosure is, therefore, indicated by the appended claims rather than by the foregoing description. Changes that come within the meaning and range of equivalency of the claims are to be embraced within their scope.

We claim:

1. A method, comprising:

providing a pump assembly that includes a displacement unit and one or more pumps that activate the displacement unit:

characterizing the one or more pumps to determine one or more performance characteristics of the one or more pumps;

under operating conditions of a first environment, calibrating a sensor associated with the displacement unit;

under operating conditions of a second environment, calibrating the sensor associated with the displacement unit; and under operating conditions of the second environment, calibrating the one or more pumps to determine one or more performance characteristics of the one or more pumps at the operating conditions of the second environment; and using the calibrated pump assembly to draw fluid from a subterranean formation.

2. The method of claim 1, wherein the one or more performance characteristics of the one or more pumps includes pump volumetric efficiency.

3. The method of claim 1, wherein characterizing of the one or more pumps to determine one or more performance characteristics of the one or more pumps comprises:

operating the one or more pumps under a plurality of predefined operating conditions, the plurality of predefined operating conditions including at least two fluid viscosities, at least two operating pressures, and at least two operating speeds.

4. The method of claim 3, wherein characterizing of the one or more pumps to determine one or more performance characteristics of the one or more pumps further comprises:

determining one or more performance characteristics of the one or more pumps based on the operation of the one or more pumps under each of the plurality of predefined operating conditions.

5. The method of claim 4, wherein characterizing of the one or more pumps to determine one or more performance characteristics of the one or more pumps further comprises:

generating one or more data curves of the one or more performance characteristics of the one or more pumps for each of the plurality of predefined operating conditions.

6. The method of claim 1, wherein calibrating a sensor associated with the displacement unit under operating conditions of a first environment comprises:

moving a piston of the displacement unit in a first stroke direction until the piston reaches an end of a first stroke; and moving the piston of the displacement unit in a second stroke direction through a known stroke length.

7. The method of claim 6, wherein calibrating a sensor associated with the displacement unit under operating conditions of a first environment further comprises:

monitoring an operating parameter of the one or more pumps and a signal produced by the sensor during movement of the piston in the second stroke direction; and correlating the operating parameter of the one or more pumps and the signal produced by the sensor to generate one or more sensor signal data vs. piston position data curves.

8. The method of claim 6, wherein moving the piston of the displacement unit in a second stroke direction through a known stroke length comprises:

moving the piston of the displacement unit in a second stroke direction until the piston reaches an end of a second stroke.

9. The method of claim 1, wherein calibrating a sensor associated with the displacement unit under operating conditions of a second environment comprises:

moving a piston of the displacement unit in a first stroke direction until the piston reaches an end of a first stroke; and moving the piston of the displacement unit in a second stroke direction through a known stroke length.

10. The method of claim 9, wherein calibrating a sensor associated with the displacement unit under operating conditions of a second environment further comprises:

monitoring an operating parameter of the one or more pumps and a signal produced by the sensor during movement of the piston in the second stroke direction; and correlating the operating parameter of the one or more pumps and the signal produced by the sensor to generate one or more sensor signal data vs. piston position data curves.

11. The method of claim 9, wherein moving the piston of the displacement unit in a second stroke direction through a known stroke length comprises:

moving the piston of the displacement unit in a second stroke direction until the piston reaches an end of a second stroke.

12. The method of claim 1, wherein characterizing the one or more pumps comprises individually characterizing a first pump of the one or more pumps and characterizing a second pump of the one or more pumps.

13. A method, comprising:

providing a downhole tool having a pump assembly, the pump assembly comprising:

a displacement unit including a piston having a first piston head positioned in a first cylinder, a second piston head positioned in a second cylinder, and a sensor that detects the position of the piston;

a first pump that selectively activates the displacement unit; and a second pump that selectively activates the displacement unit;

characterizing the first and second pumps to determine performance characteristics of the first and second pumps under a plurality of predefined operating conditions;

calibrating the sensor prior to positioning the downhole tool in a borehole;

calibrating the sensor while the downhole tool is positioned in the borehole;

calibrating the second pump while the downhole tool is positioned in the borehole; and conducting a formation test using the calibrated pump assembly in the borehole extending into a subterranean formation.

14. The method of claim 13, wherein calibrating the sensor prior to positioning the downhole tool in a borehole comprises:

moving the piston from a first known position, through a full stroke length to a second known position; and monitoring a signal produced by the sensor during movement of the piston through the full stroke length.

15. The method of claim 13, wherein calibrating the sensor while the downhole tool is positioned in the borehole comprises:

moving the piston from a first known position, through a full stroke length to a second known position; and monitoring a signal produced by the sensor during movement of the piston through the full stroke length.

16. The method of claim 15, wherein calibrating the first pump while the downhole tool is positioned in the borehole comprises:

operating the first and second pumps to move the piston to a known intermediate position determined by a signal produced by the sensor; and operating the second pump to move the piston from the known intermediate position to an end of a stroke.

17. A method, comprising:

providing a pump assembly, comprising:

a displacement unit including a piston having a first piston head positioned in a first cylinder, a second piston head positioned in a second cylinder, and a sensor;

a first pump that selectively activates the displacement unit; and a second pump that selectively activates the displacement unit;

monitoring a signal produced by the sensor;

determining the position of the piston using the signal produced by the sensor;

calibrating at least one of the first and second pumps using the position of the piston and conducting a formation evaluation using fluid drawn from the calibrated pump assembly from a subterranean formation.

18. The method of claim 17, further comprising characterizing the first and second pumps to determine performance characteristics of the first and second pumps under a plurality of predefined operating conditions.

19. The method of claim 17, wherein at least one of the first piston head or the second piston head comprises a magnetic field producing component and the sensor comprises a giant magnetoresistance sensor.

20. The method of claim 17, wherein calibrating at least one of the first and second pumps using the position of the piston comprises:

operating one of the first and second pumps to move the piston from a first known position to a second known position, at least one of the first and second known positions being determined from the signal produced by the sensor; and monitoring the time it takes to move the piston from the first known position to the second known position.

* * * * *